United States Patent [19]

Kovach

[11] 4,398,443

[45] Aug. 16, 1983

[54] PRECISION TUNING PIN FOR PIANOS

[76] Inventor: Bruce F. Kovach, 5918 Radnor, Detroit, Mich. 48224

[21] Appl. No.: 380,523

[22] Filed: May 21, 1982

[51] Int. Cl.[3] ..... G10C 3/10

[52] U.S. Cl. ..... 84/201; 84/304

[58] Field of Search ..... 84/200–208, 84/304–306, 312 R

[56] References Cited

U.S. PATENT DOCUMENTS 638,154 11/1899 Walker ..... 84/201

1,924,720 8/1933 Kringel ..... 84/201

FOREIGN PATENT DOCUMENTS 155359 12/1930 United Kingdom ..... 84/304

*Primary Examiner*—Lawrence R. Franklin

[57] ABSTRACT

A tuning pin for pianos and like instruments being of the usual configuration except for the neck portion on which the string is wound which is reduced in diameter only on the side which the string leaves the pin thus forming a pin neck which is more elliptical than circular in shape, the reduced side of which has a less acute curve for the string to bend around and is closer to the center of axes of the pin which reduces the torsional effect of the string on the pin and subsequent slippage of the pin in the block.

1 Claim, 3 Drawing Figures

PRECISION TUNING PIN FOR PIANOS

FIELD OF INVENTION

This invention relates to a tuning pin around which one end of a piano string is wound to hold the same taunt.

DISCUSSION OF PRIOR ART

Various tuning pins have been designed in the past having either enlarged threaded body portions or reduced neck portions or both for the purpose of reducing the torsional effect of the string pulling on the pin and thus reducing pin slippage in the pin block. These changes can be only minor because enlarging the pin body weakens the pin block and reducing the pin neck diameter weakens the pin and results in more string breakage where the string bends around the pin. Currently there are bushings being sold for the purpose of fixing loose pins in pin blocks however to use these bushings the hole in the pin block must be drilled out large enough to accept the bushing which can dangerously weaken the block especially when a number of bushings are installed.

BRIEF SUMMARY AND OBJECTS

The tuning pin is of the usual configuration which is in common use today except for the neck portion on which the string is wound which is reduced in diameter only on the side which the string leaves the pin when the string is up to pitch. Some of the objects of this invention are:

1. To provided a less acute curved surface where the string first bends around the pin in order to reduce string breakage at that point.
2. To make the point where the string begins to bend around the pin closer to the axis of the pin in order to provide much more accurate tuning and at the same time reduce the torsional effect of the string on the pin and subsequent slippage of the pin in the block.
3. To inexpensively adapt a standard pin to this invention by performing one grinding operation on the neck of the pin.
4. To provide a pin which will not slip no matter how loose it is in the block thus making them ideal for replacing slipping pins in cracked piano blocks which otherwise would have to be replaced at great expense.
5. To provide a piano pin that can greatly reduce the time needed to tune a piano equipped with such pins and at the same time extend the time such a piano stays in tune.

Further objects and advantages of my invention will become apparent from a consideration of the drawings and ensuing description thereof.

DETAILED DESCRIPTION

Figure 1:
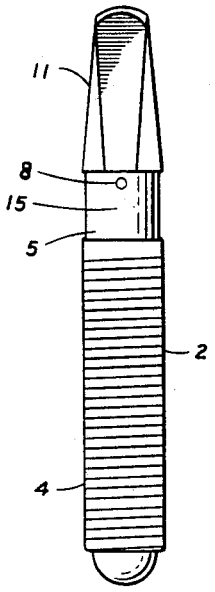
FIG. 1 is a front elevation of the pin.
Figure 2:
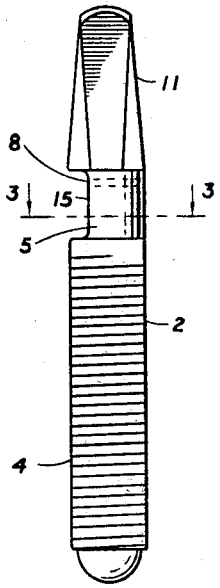
FIG. 2 is a side elevation thereof.
Figure 3:
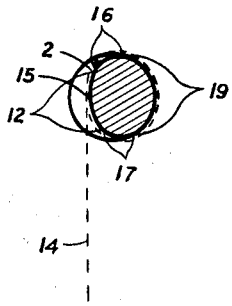
FIG. 3 is a cross-sectional view thereof on line 3, 3 of FIG. 2.

The pin 2 has a head 11 of standard size and construction with four flat surfaces for turning the pin 2 with the tuning hammer. The body 4 is of the usual size and is theaded. A hole 8 is bored through the pin 2 in the usual manner. The neck 5 is of a reduced diameter only on the side which the string leaves the pin 2 when the string is up to pitch. The degree of curvature of the surface of the neck 5 changes from the normal curvature 19 to a smaller curvature 16 to a much larger curvature 12 to a smaller curvature 17 and back to the normal degree of curvature 19. When the pin 2 is installed in a piano the string as indicated by the dotted line 14 is carefully measured and cut so that the string 14 when wound around the pin neck 5 and brought up to pitch will leave contact with the neck 5 on the reduced side 15 of the neck 5 which has the larger surface curvature 12. Because the string 14 begins to bend around the neck 5 at the neck's area of larger surface curvature 12, the string 14 is much less likely to break at that point than if a standard pin were used. Because the string 14 makes contact with the neck 5 at a point about twice as close to the center of the pin 2 as is usual the leverage effect of the string 14 is reduced to a point where the pin 2 will not slip no matter how loose it becomes in the block because the friction created between the pin and the block by the string pulling against the pin is greater than the torsional effect of the string on the pin. Further, it becomes possible to tune much more accurately because the same degree of turning of the pin 2 moves the string a much lesser degree than it would if a normal pin were being turned. Because the new pin 2 will not slip it is possible for them to be installed much less tightly in the block than is usual which besides reducing the chance of a cracked or damaged block, further speeds tuning because less friction of the pin in the block combined with less leverage of the string on the pin lessens the force that need be applied by the tuning hammer which in turn greatly lessens twisting and bending of the pin in tuning, an effect which greatly slows tuning. Because much less force is needed for tuning, chances of pin breakage are reduced even though the pin neck 5 has been reduced somewhat in size. While the above description contains many specificites, these should not be construed as limitations on the scope of the invention but rather as an exemplification of one preferred embodiment thereof. Many other variations are possible for example the hole 8 may be angled up into the pin head 11 in order to increase the strength of the pin neck 5 as has been described in previous patents. Accordingly the scope of the invention should be determined not by the embodiments illustrated, but by the appended claims and their legal equivalents.

I claim:

1. A metallic tuning pin for pianos and like instruments comprising a body portion substantially the whole length of which is adapted to be placed in and held by the pin board of the instrument, a head shaped for turning the pin by a tuning hammer, a neck between said body portion and said head for the winding of the string therearound, said neck being reduced in diameter only on the side which the string leaves the pin when the string is up to pitch, thus forming a pin neck which is more elliptical than circular in shape, the said reduced side of which has a less acute surface curvature than that of the pin body, and a string hole in said neck.

* * * * *